US007280774B2

(12) United States Patent
Kang

(10) Patent No.: US 7,280,774 B2
(45) Date of Patent: Oct. 9, 2007

(54) APPARATUS AND METHOD FOR AUTOMATICALLY ADJUSTING TONER DENSITY IN A COLOR PRINTER

(75) Inventor: Byung-Tae Kang, Yougin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 162 days.

(21) Appl. No.: 11/251,794

(22) Filed: Oct. 18, 2005

(65) Prior Publication Data

US 2006/0083523 A1 Apr. 20, 2006

(30) Foreign Application Priority Data

Oct. 19, 2004 (KR) ..... 10-2004-0083760

(51) Int. Cl.
*G03G 15/08* (2006.01)
*G03G 15/01* (2006.01)
*G03G 15/10* (2006.01)

(52) U.S. Cl. ..... 399/27; 399/28; 399/61

(58) Field of Classification Search ..... 399/27, 399/28, 29, 61
See application file for complete search history.

(56) References Cited

U.S. PATENT DOCUMENTS 6,871,026 B2 * 3/2005 Shimura et al. ..... 399/12
2004/0179856 A1 * 9/2004 Suzuki ..... 399/27
2005/0063714 A1 * 3/2005 Kinoshita et al. ..... 399/27

* cited by examiner

*Primary Examiner*—Hoang Ngo
(74) *Attorney, Agent, or Firm*—Staas & Halsey LLP

(57) ABSTRACT

An apparatus and method for automatically adjusting toner density in a color printer,. The apparatus includes a toner quantity adjusting module for reading remaining toner quantities from a plurality of cartridges, respectively, comparing a lowest level of the remaining toner quantities with a reference remaining quantity range to determine whether or not the lowest level is in the reference remaining quantity range, and applying a masking table, in which toner density matching the lowest level is set, to the remaining cartridges. Accordingly, toners can be fixed at the toner density matching the remaining toner quantity in the cartridges of the color printer so as to maintain optimum color density substantially equal to that of the original data, thereby providing a user with a printed material of desirable colors.

6 Claims, 5 Drawing Sheets

APPARATUS AND METHOD FOR AUTOMATICALLY ADJUSTING TONER DENSITY IN A COLOR PRINTER

CROSS-REFERENCE TO RELATED APPLICATION

This application claims the benefit of Korean Patent Application No. 2004-83760, filed Oct. 19, 2004, the disclosure of which is hereby incorporated herein by reference in its entirety.

BACKGROUND OF THE INVENTION

1. Field of the Invention

The present invention relates to an apparatus and method for automatically adjusting toner density in a color printer, more particularly, by which color density to be fixed can be adjusted according to remaining toner quantity in the color printer.

2. Description of the Related Art

In general, a color printer has four color toners, i.e., yellow, magenta, cyan and black toners contained in cartridges, respectively. The color printer fixes a color toner from its cartridge onto a printing sheet to reproduce a color matching an original as best as possible. Such a color printer is also called a color laser printer.

As shown in FIG. 1, such a conventional color printer includes emulators 10 and 12 for rendering original data, i.e., original text and image data from a PC drive (not shown) and generating a resultant display list, a printer firmware 14 for generally managing the printer and executing a printing command according to the display list and an engine firmware 16 for controllably operating a printer engine in response to the printing command from the printer firmware 14 so that four color toners, i.e., yellow, magenta, cyan and black toners are fixed onto a sheet to reproduce the original data thereon.

After the display list is emulated, the emulators 10 and 12 check-in the printing with the printer firmware 14, which in turn controls the engine firmware 16 to print the checked-in original data so as to output the printed sheet.

The printer firmware 14 measures the remaining quantities of the four toners (i.e., yellow, magenta, cyan and black toners) to determine whether any of the four color toners does not exceed a predetermined level, and if any of the four color toners does not exceed the predetermined level, generates an alarm based upon at least one of visual and audio signals to notify a user of replacement time so that the user can replace the corresponding toner at a suitable time.

In the conventional color printer, however, the engine firmware 16 performs a normal printing according to the information of the display list regardless of the remaining quantities of the yellow, magenta, cyan and black toners contained in their cartridges.

If the remaining quantity of any of the yellow, magenta, cyan and black toners does not exceed the predetermined level, the corresponding color toner fed under a suitable quantity or a reference value mixes with other normal toners when they are fixed onto a paper sheet. This provides the sheet with an image having colors different from those of the original data.

SUMMARY OF THE INVENTION

The present invention has been made to solve the foregoing problems of the prior art and it is therefore an object of the invention to provide an apparatus and method for automatically adjusting toner density, by which toners can be fixed at a toner density matching a remaining toner quantity in a cartridge of the color printer so as to maintain optimum color density substantially the same as that of the original data.

According to an aspect of the invention for realizing the above objects, there is provided an apparatus for automatically adjusting toner density in a color printer comprising a toner quantity adjusting module for reading remaining toner quantities from a plurality of cartridges, respectively, comparing a lowest level of the remaining toner quantities with a reference remaining quantity range to determine whether or not the lowest level is in the reference remaining quantity range, and applying a masking table, in which toner density matching the lowest level is set, to remaining ones of the cartridges as masking tables thereof.

Preferably, the masking tables may contain a plurality of critical remaining quantities set gradually different from one another so that the lowest level is classified according to reference remaining quantity ranges defined between the critical remaining quantities and thus toner density data different from one another are set.

In addition, the toner quantity adjustment module stores the masking tables according to toners so as to be provided to an engine firmware or a printer firmware in response to a printing command.

According to an aspect of the invention for realizing the above objects, there is provided a method for automatically adjusting toner density in a color printer using a plurality of toner cartridges, the method comprising the steps of: detecting at least one cartridge containing a lowest level of remaining toner quantity from the cartridges; and setting a toner density matching the lowest level to other cartridges. Preferably, the method may further comprise the step of printing onto a sheet at the toner density.

Preferably, the step of setting a toner density matching the lowest level to other cartridges may comprise: judging whether or not the lowest level is equal to or less than any one of the critical remaining quantities, and applying one of masking tables for setting a toner density matching the remaining critical quantity.

In addition, the masking table may contain a plurality of critical remaining quantities set gradually different from one another so that the lowest level is classified according to reference remaining quantity ranges defined between the critical remaining quantities and thus toner density data different from one another are set.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
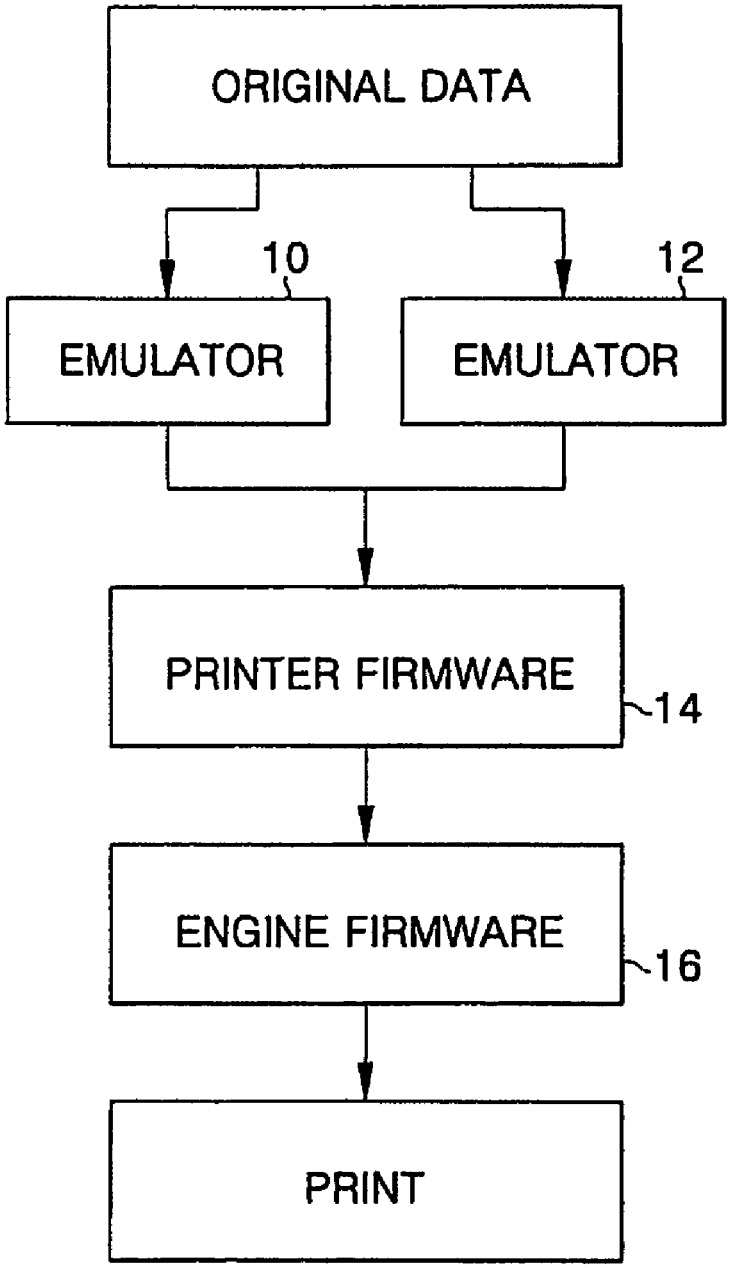
FIG. 1 (PRIOR ART)
FIG. 1 is a block diagram illustrating a conventional printing module for a color printer.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
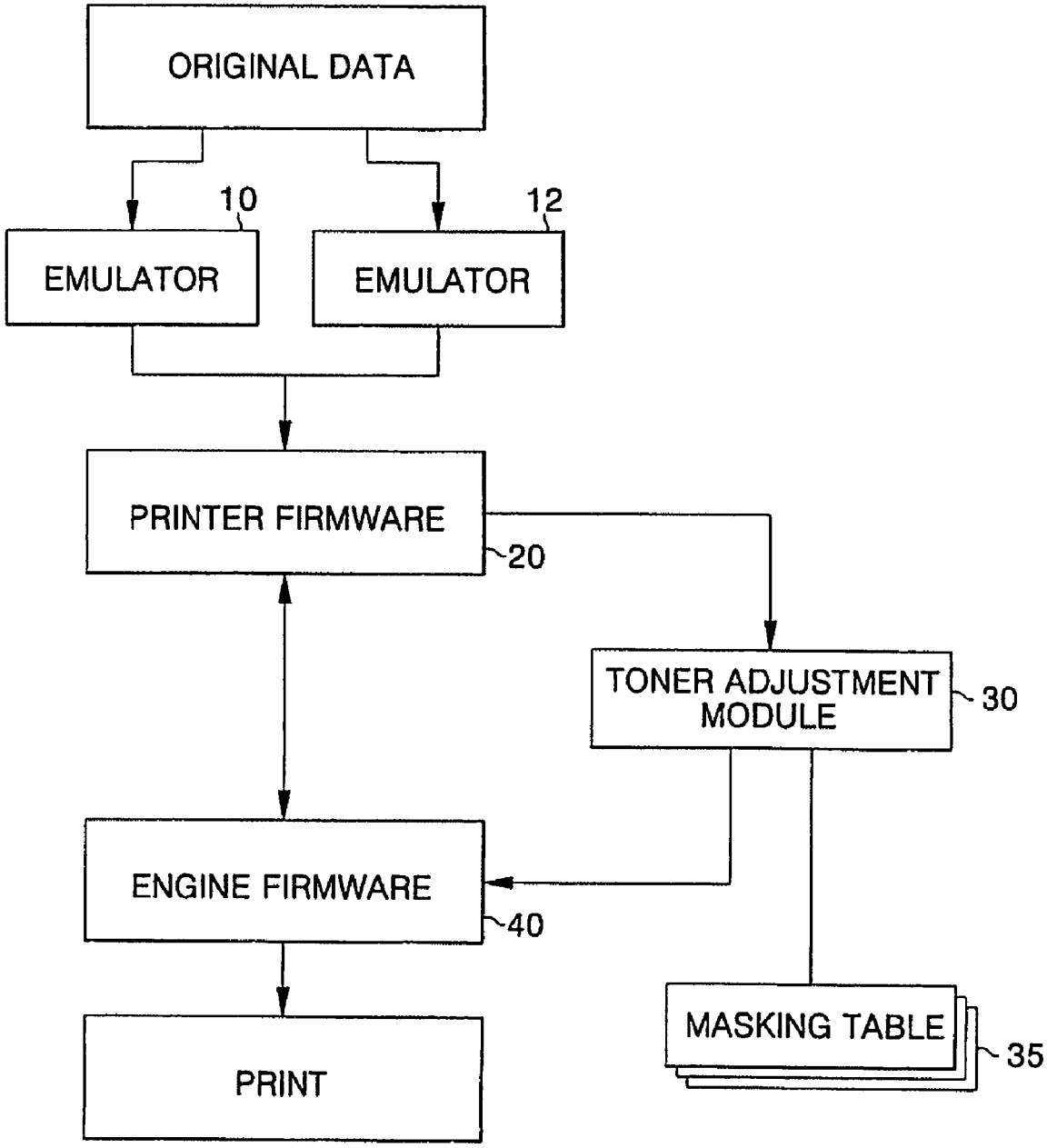
FIG. 2 is a block diagram illustrating an apparatus for automatically adjusting toner density in a color printer according to the invention.
Figure 3:
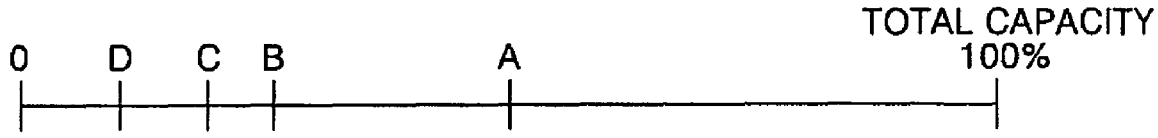
FIG. 3 is an illustration of a table of an automatic adjustment module of the invention.
Figure 4A:
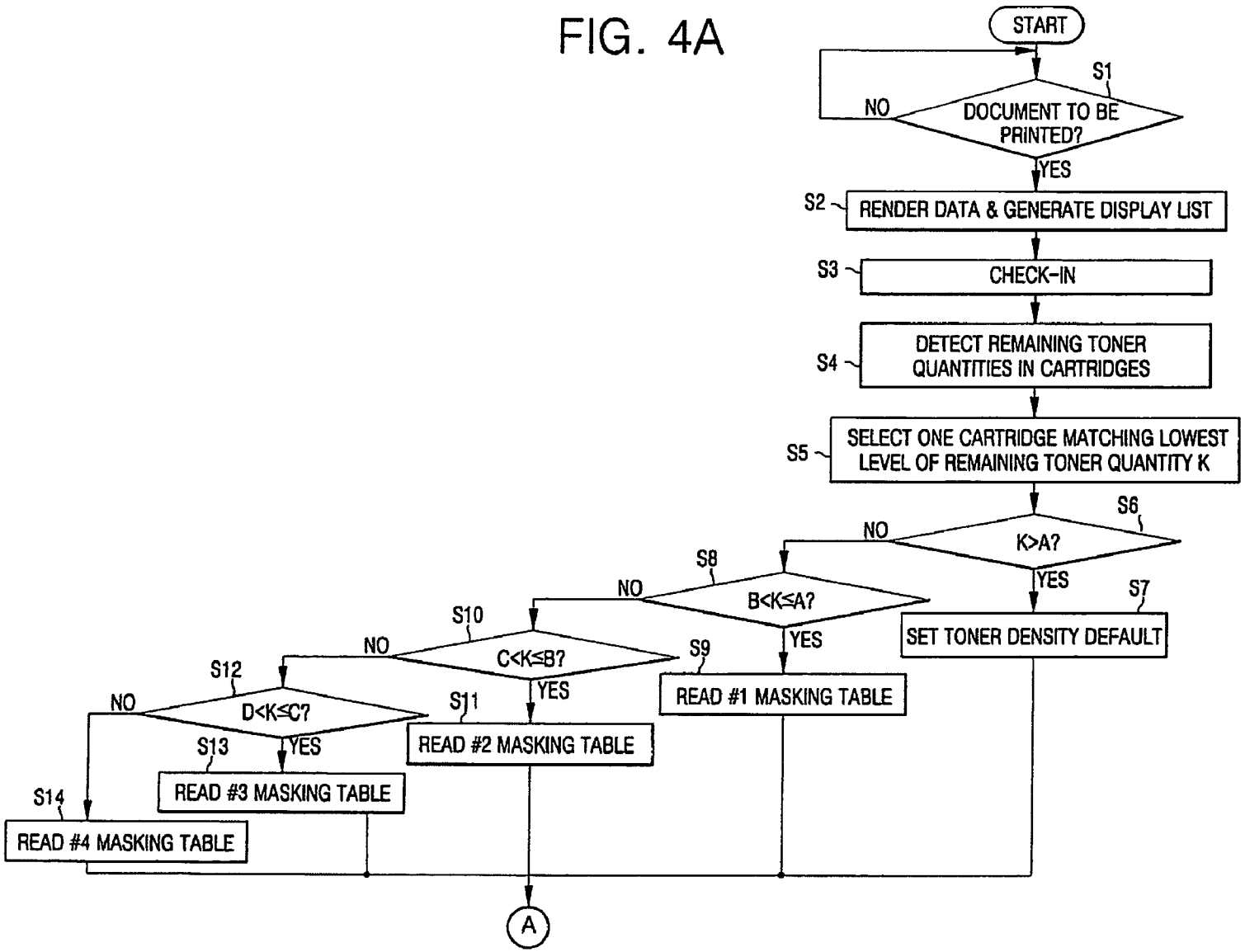
FIGS. 4A and 4B are a flowchart illustrating a method for automatically adjusting toner density in a color printer according to the invention.
Figure 4B:
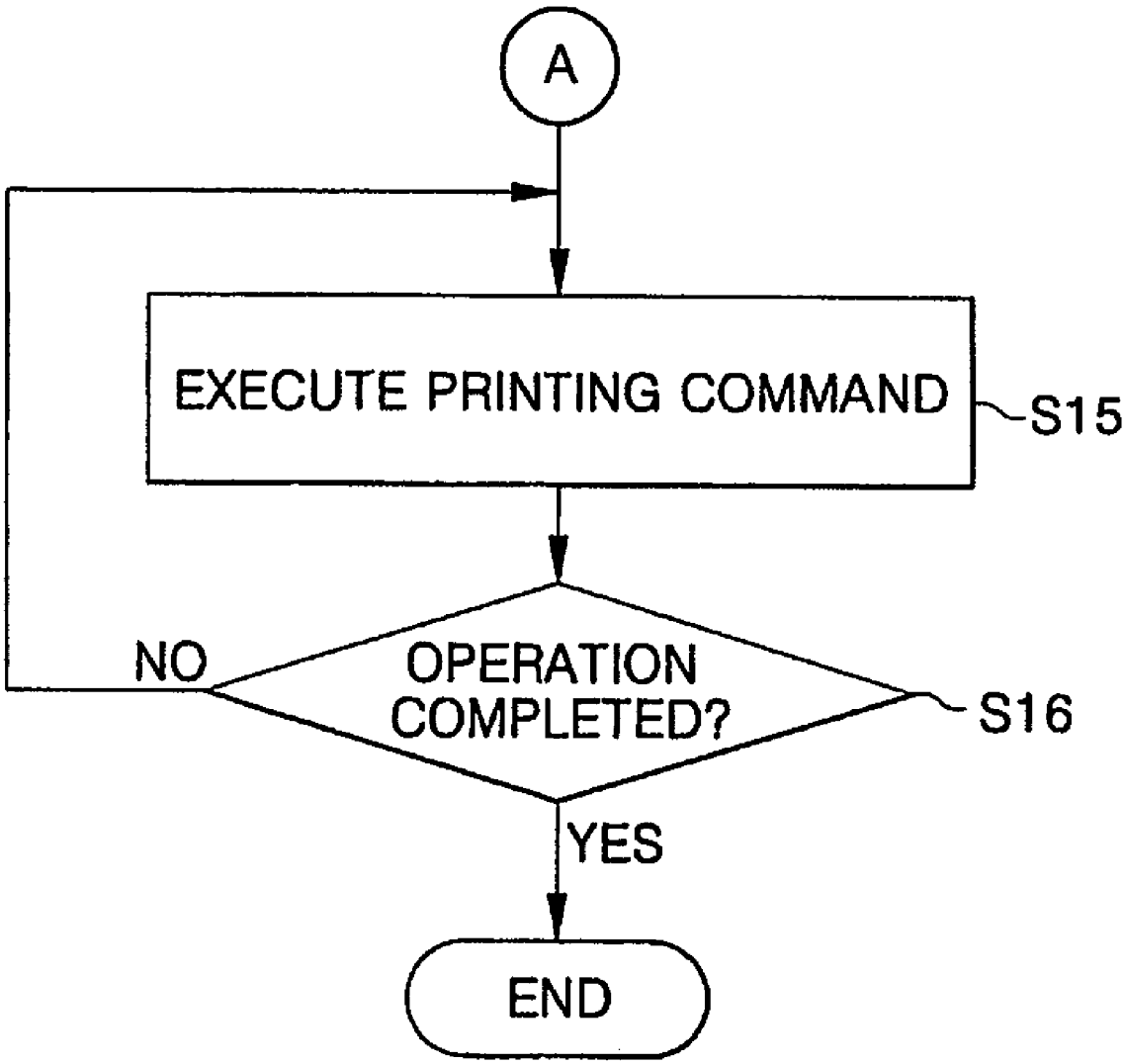

The following detailed description presents an apparatus and method for automatically adjusting toner density in a color printer according to the invention in conjunction with the accompanying drawings, in which FIG. 2 is a block diagram illustrating an apparatus for automatically adjusting toner density in a color printer according to the invention, FIG. 3 is an illustration of a table of an automatic adjustment module of the invention, and FIGS. 4A and 4B are a flowchart illustrating a method for automatically adjusting toner density in a color printer according to the invention.

As shown in FIG. 2, the apparatus for automatically adjusting toner density in a color printer according to the invention includes emulators 10 and 12, a printer firmware 20, an engine firmware 40 and a toner quantity adjustment module 30.

First, when a color printer (not shown) receives an original data to be printed from a PC (not shown), the emulators 10 and 12 execute rendering. That is, upon receiving the original data (including text and image data) from the PC (not shown), the emulators 10 and 12 render the original data into printable data thereby generating a display list. At the same time, the emulators 10 and 12 examine whether or not the printer firmware 20 can execute printing.

The printer firmware 20 examines all cartridges (not shown) contained inside the printer (not shown) to detect the remaining quantities K of color toners contained in the cartridges, respectively. When the remaining toner quantities K are detected, an algorithm determines the toner densities of the cartridges based upon the remaining toner quantities K. Then, the printer firmware 20 outputs a printing command of the display list. Herein the toners include four color toners, that is, yellow, magenta, cyan and black toners for expressing natural colors, and are contained in their cartridges, respectively. According to the algorithm, the toners are directly fixed onto a printing sheet to express the original data.

The algorithm is executed by the toner quantity adjustment module 30 as follows: When the remaining toner quantities of all the cartridges are measured by the printer firmware 20, one cartridge having the smallest remaining toner quantity K is detected. Then, the smallest remaining toner quantity K of the detected cartridge is compared with a preset critical remaining quantity, so that the smallest remaining toner quantity K is equally applied to the remaining cartridges.

Herein the term "critical remaining quantity" means a predetermined quantity of a specific color toner remaining in a cartridge. When the remaining quantity of the color toner decreases to the "critical remaining quantity", the quantity of the color toner fed from the cartridge is reduced to a level so that the color toner is not harmonized with other color toners fed from other cartridges, thereby failing to reproduce the colors of the original data. As shown in FIG. 3, such lack of harmony really takes place at a critical remaining quantity A corresponding to, e.g., 47% of a cartridge's capacity, a critical remaining quantity B corresponding to, e.g., 25%, a critical remaining quantity C corresponding to, e.g., 19%, and a critical remaining quantity D corresponding to, e.g., 10%, when toner quantity fully filled into a cartridge is set 100%.

Accordingly, the toner quantity adjustment module 30 detects a cartridge having the smallest remaining toner quantity, and compares its remaining toner quantity K in succession with the preset critical remaining quantities A, B, C and D. If the remaining toner quantity K is the critical remaining quantity A or more, the original data can be reproduced as they are, and thus all toner densities are set to default to prepare for a normal printing.

However, if the remaining toner quantity K is the critical remaining quantity A or less, while exceeding the next critical remaining quantity B, #1 masking table 35 is read from a storage area to prepare for printing. According to the #1 masking table 35, toner densities to be fixed by other cartridges are set equal with the toner density which can be fixed by the corresponding cartridge at the critical remaining quantity A or less.

If the remaining toner quantity K is the critical remaining quantity B or less, while exceeding the next critical remaining quantity C, #2 masking table 35 is read from the storage area to prepare printing. According to the #2 masking table 35, toner densities to be fixed by other cartridges are set equal with the toner density which can be fixed by the corresponding cartridge at the critical remaining quantity B or less.

Further, if the remaining toner quantity K is the critical remaining quantity C or less, while exceeding the next critical remaining quantity D, #3 masking table 35 is read from the storage area to prepare printing. According to the #3 masking table 35, toner densities to be fixed by other cartridges are set equal with the toner density which can be fixed by the corresponding cartridge at the critical remaining quantity C or less.

Finally, if the remaining toner quantity K is the critical remaining quantity D or less, while exceeding 0%, #4 masking table 35 is read from the storage area to prepare printing. According to the #4 masking table 35, toner densities to be fixed by other cartridges are set equal with the toner density which can be fixed by the corresponding cartridge at the critical remaining quantity D or less.

As a result, when the toner quantity adjustment module 30 sets a specific masking table 35 indicating a toner density which can be fixed by one cartridge having the lowest remaining toner quantity, the masking table 35 sets this toner density equally to the other toners to be fixed by the remaining cartridges. In this case, the masking table is set equally in a range between one critical remaining quantity and the next critical remaining quantity.

Then, in response to a printing command from the printer firmware 20, the engine firmware 40 executes printing to reproduce the original data onto the printing sheet according to the rendered display list, by which toners are fed from all cartridges at the same toner density corresponding to the lowest remaining quantity according to the masking table 35 set by the toner quantity adjustment module 30. Then, an output image of colors substantially the same as those of the original data can be produced.

The apparatus for automatically adjusting toner density in a color printer according to the invention operates according to a flowchart as shown in FIGS. 4A and 4B.

First, in S1, the overall operation of the color printer starts with detecting that an original data such as a document or image to be printed is outputted from a PC. When the operation is started, corresponding emulators 10 and 12 receive the original data, render the original data into printable data, and generate a resultant display list in S2. Then, in S3, the emulators 10 and 12 check-in whether the printer firmware 20 is operatable or not. At this time, if the printer firmware 20 is printing other data, the emulators 10 and 12 maintain a standby status.

In S4, examination is performed of the cartridges (not shown) which are mounted inside the printer body (not shown) and have a plurality of different color (yellow, magenta, cyan and black) toners contained therein in order to detect the remaining toner quantities K, and in S5, one cartridge having the lowest level of remaining toner quantity K is selected. When the lowest level of remaining toner quantity is detected from two or more cartridges, only one of them is selected.

An algorithm is executed to read a masking table 35 from the storage area so that the toner density that can be taken from the single selected cartridge is set equally to the other cartridges.

That is, if the lowest level of remaining toner quantity K of the selected cartridge is larger than the critical remaining quantity A in S6, toner density is set to default so that the engine firmware 40 can perform printing by default in S7.

If the remaining toner quantity K is in a range at the critical remaining quantity A or less, while exceeding the critical remaining quantity B in S8, the #1 masking table 35 is read from the storage area to set a toner density that can be taken from a cartridge having a remaining toner quantity at the critical remaining quantity A or less is set to all cartridges in S9.

If the remaining toner quantity K is in a range at the critical remaining quantity B or less, while exceeding the critical remaining quantity C in S10, the #2 masking table 35 is read from the storage area to be set to all cartridges in S11.

If the remaining toner quantity K is in a range at the critical remaining quantity C or less, while exceeding the critical remaining quantity D in S12, the #3 masking table 35 is read from the storage area to be set to all cartridges in S13.

If the remaining toner quantity K is in a range at the critical remaining quantity D or less, while exceeding 0% in S12, the #4 masking table 35 is read from the storage area to be set equally to all cartridges in S14.

In this case, if the remaining toner quantity K intermediates between the critical remaining quantities A and B, the density of toner that can be fed is substantially constant. Also, if the remaining toner quantity K gradually decreases along with the critical remaining quantity, the density of toner that can be fed is also reduced.

Then, in S15, the original data of the rendered display list is printed out so that toner density is fixed according to the masking table 35 set according to the rendered display list in conjunction with the printing command. In S16, the above step of S15 is repeated until the printing is completely finished.

The apparatus and method for automatically adjusting toner density in a color printer according to the invention can use an algorithm to eliminate vague colors which may occur at a critical remaining quantity or less, thereby obtaining an image having colors substantially the same as those of an original data.

According to the invention, toners can be fixed at a toner density matching a remaining toner quantity in a cartridge of the color printer so as to maintain optimum color density substantially equal to that of the original data, thereby providing a user with a printed material of desirable colors.

Although a few embodiments of the present inventive concept have been shown and described, it would be appreciated by those skilled in the art that changes may be made in these embodiments without departing from the principles and spirit of the general inventive concept, the scope of which is defined in the appended claims and their equivalents.

What is claimed is:

1. An apparatus for automatically adjusting toner density in a color printer comprising a toner quantity adjusting module for reading remaining toner quantities from a plurality of cartridges, respectively, comparing a lowest level of the remaining toner quantities with a reference remaining quantity range to determine whether or not the lowest level is in the reference remaining quantity range, and applying a masking table, in which toner density matching the lowest level is set, to remaining ones of the cartridges as masking tables thereof.

2. The apparatus for automatically adjusting toner density according to claim 1, wherein the masking tables contain a plurality of critical remaining quantities set gradually different from one another so that the lowest level is classified according to reference remaining quantity ranges defined between the critical remaining quantities and thus toner density data different from one another are set.

3. The apparatus for automatically adjusting toner density according to claim 1, wherein, when the lowest level of the remaining toner quantities is detected from more than one of the plurality of cartridges, the toner quantity adjusting module selects only one of the cartridges as the lowest level of the remaining toner quantities.

4. A method for automatically adjusting toner density in a color printer using a plurality of toner cartridges, the method comprising the steps of:

reading remaining toner quantities in the cartridges, respectively, and comparing a lowest level of the remaining toner quantities with a reference remaining quantity range to determine whether or not the lowest level is in the reference remaining quantity range; and setting toner density matching the lowest level to remaining ones of the cartridges.

5. The method for automatically adjusting toner density according to claim 4, wherein the masking tables contain a plurality of critical remaining quantities set gradually different from one another so that the lowest level is classified according to reference remaining quantity ranges defined between the critical remaining quantities and thus toner density data different from one another are set.

6. The method for automatically adjusting toner density according to claim 4, wherein, when the lowest level of the remaining toner quantity is detected from more than one of the plurality of cartridges, selecting only one of the cartridges as the lowest level of the remaining toner quantity.

* * * * *

UNITED STATES PATENT AND TRADEMARK OFFICE

CERTIFICATE OF CORRECTION

PATENT NO. : 7,280,774 B2
APPLICATION NO. : 11/251794
DATED : October 9, 2007
INVENTOR(S) : Byung-Tae Kang It is certified that error appears in the above-identified patent and that said Letters Patent is hereby corrected as shown below:

Title Page, item [57] Column 2 (Abstract), Line 2, change “printer,.” to --printer.--

Signed and Sealed this

Seventeenth Day of June, 2008

JON W. DUDAS
*Director of the United States Patent and Trademark Office*